United States Patent [19]

Thompson

[11] Patent Number: 4,463,770

[45] Date of Patent: Aug. 7, 1984

[54] METHODS AND APPARATUS FOR TREATING SMOKING ARTICLES

[76] Inventor: Harold Thompson, 1120 Park Ave., New York, N.Y. 10028

[21] Appl. No.: 332,509

[22] Filed: Dec. 21, 1981

Related U.S. Application Data

[63] Continuation of Ser. No. 113,048, Jan. 17, 1980, abandoned, which is a continuation of Ser. No. 870,079, Jan. 17, 1978, abandoned.

[51] Int. Cl.[3] ..... A24F 13/90

[52] U.S. Cl. ..... 131/329

[58] Field of Search ..... 131/329, 253, 252, 281

[56] References Cited

U.S. PATENT DOCUMENTS

| | | | |
|---|---|---|---|
| 925,158 | 6/1909 | Cragg | 131/252 |
| 3,405,718 | 10/1968 | Grassi | 131/253 X |
| 4,046,152 | 9/1977 | Purdon | 131/253 X |

*Primary Examiner*—Stephen C. Pellegrino

*Attorney, Agent, or Firm*—Davis, Hoxie, Faithfull & Hapgood

[57] ABSTRACT

Smoking articles such as cigarettes, cigars, and the like are treated to alter the composition of the smoke constituents received by the smoker by forming one or more transverse ducts through the portion of the side wall of the smoking article which remains outside the smoker's mouth and extending into the smoking article a distance at least equal to the radius of the smoking article. In particular, the composition of the smoke constituents may be altered to reduce unwanted or undesirable gases and/or particulate matter. A treated smoking article includes one or more such ducts. If desired, the smoking habit may be substantially reduced or broken by gradually increasing the number of such ducts to produce a corresponding reduction in nicotine or other constituent consumption in steps which are readily acceptable to the smoker.

9 Claims, 10 Drawing Figures

METHODS AND APPARATUS FOR TREATING SMOKING ARTICLES

This is a continuation of application Ser. No. 113,048, filed Jan. 12, 1980, which is a continuation of application Ser. No. 870,079, filed Jan. 17, 1978, both abandoned.

BACKGROUND OF THE INVENTION

This invention relates to altering the composition of the smoke constituents received by the smoker of cigarettes, cigars, and the like to reduce the quantities of unwanted or undesirable gases and/or particulate matter in the smoke, and to reducing the addictive quality of such smoking articles in a way which facilitates reducing or breaking the smoking habit. More particularly, the invention relates to methods and apparatus for treating cigarettes, cigars, and the like to reduce the quantities of undesirable and addictive substances received by the smoker, to the smoking articles which result from such treatment, and to methods of breaking the smoking habit using such treatment of smoking articles or using smoking articles so treated.

It is now generally recognized that the smoking of cigarettes, cigars, and the like can affect the health of the smoker. The possible relationships between lung cancer, heart and circulatory diseases, emphysema, chronic bronchitis, etc., and the particulate matter ("tar") and gases such as carbon monoxide, hydrogen cyanide, nitrogen oxides, etc., in tobacco smoke have been extensively studied.

Despite the publicity given these health considerations, many smokers are unable to substantially reduce or stop smoking. This is due in large part to the presence of nicotine in tobacco smoke which is recognized as habit-forming or addictive. Many cigarette smokers, in an effort to reduce the health hazards associated with smoking, have switched from unfiltered to filtered cigarettes, or from lightly filtered to more heavily filtered cigarettes. But to satisfy their requirement for nicotine, many of these individuals find themselves smoking greater numbers of cigarettes so that the intake of undesirable substances is not substantially reduced. In addition, many filtered cigarettes do not reduce the intake of gases such as carbon monoxide, and some may even increase the intake of those gases as compared to unfiltered cigarettes.

Many of the techniques for aiding smokers in reducing or breaking the smoking habit are unsatisfactory because they interfere too drastically with the act of smoking or the satisfaction derived from it. For example, it has been found that if the amount of nicotine received from a cigarette is suddenly reduced by more than about 25%, the smoker is noticeably unsatisfied by the cigarette and is either uncomfortable or will smoke another cigarette. Similarly, if the taste or draw resistance of a cigarette is altered too substantially, or if a holder is required, the smoker may find the interference unacceptable.

In view of the foregoing, it is an object of this invention to provide methods and apparatus for treating cigarettes, cigars, and the like to reduce the quantities of undesirable and addictive substances, both particulate and gaseous, received by the smoker.

It is another object of the invention to provide methods and apparatus for treating cigarettes, cigars, and the like to permit controlled, step-wise reduction of the quantity of nicotine received by the smoker from smoking successive smoking articles so that the addiction to nicotine can be gradually reduced without trauma and the smoking habit broken.

It is a further object of this invention to provide cigarettes, cigars, and the like which have been treated to reduce the quantities of undesirable and addictive substances received by the smoker.

It is still another object of this invention to provide a method of breaking the smoking habit by treating cigarettes, cigars, and the like to reduce the smoker's intake of nicotine from successive smoking articles in a controlled, step-wise manner.

SUMMARY OF THE INVENTION

These and other objects of the invention are accomplished in accordance with the principles of the invention by methods and apparatus for forming one or more ducts (referred to herein as transverse ducts) through the side wall and into the interior of a cigarette, cigar, or similar smoking article. Each transverse duct passes through the portion of the side wall of the smoking article which remains outside the smoker's mouth and has length at least equal to the radius of the smoking article. The transverse ducts may be arranged in various patterns and may have various angles and depths of penetration, including passing all the way through the smoking article. Preferably, each transverse duct is approximately perpendicular to the longitudinal axis of the smoking article and passes through only one side of the smoking article. Preferably also, if more than one transverse duct is formed in the smoking article, the ducts are spaced longitudinally and circumferentially along the portion of the smoking article which remains unsmoked and outside the smoker's mouth.

Apparatus for treating smoking articles in accordance with the invention may comprise a body having a first aperture for receiving the smoking article and a second aperture at an angle (preferably perpendicular) to the longitudinal axis of the first aperture and in communication therewith. A plunger is disposed in the second aperture for reciprocal motion along the longitudinal axis of the second aperture. At least one incisor extends from the end of the plunger for insertion into the first aperture upon reciprocation of the plunger. Means are provided for reciprocating the plunger so that the incisor or incisors enter the first aperture and create one or more transverse ducts as mentioned above in a smoking article positioned in the first aperture.

A smoking article treated in accordance with the invention includes one or more transverse ducts as mentioned above in the portion of the article which remains outside the smoker's mouth and which also preferably remains unsmoked.

A method of reducing or breaking the smoking habit in accordance with the invention comprises treating successive smoking articles with a gradually increasing number of transverse ducts as mentioned above.

Further features of the invention, its nature, and various advantages will be more apparent from the accompanying drawing and the following detailed description.

DETAILED DESCRIPTION OF THE INVENTION

The principles of this invention are applicable to a wide variety of smoking articles including filtered and unfiltered cigarettes, cigars, and the like. The term "smoking article" is used generically herein to refer to all such products. The invention will be described primarily in its application to treating filter cigarettes, it being understood that this is merely illustrative and that the invention is equally applicable to treating smoking articles generally as stated above.

Figure 1:
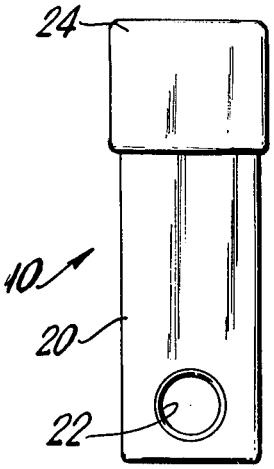
FIG. 1 is a front view of apparatus for treating a cigarette in accordance with the invention.
Figure 2:
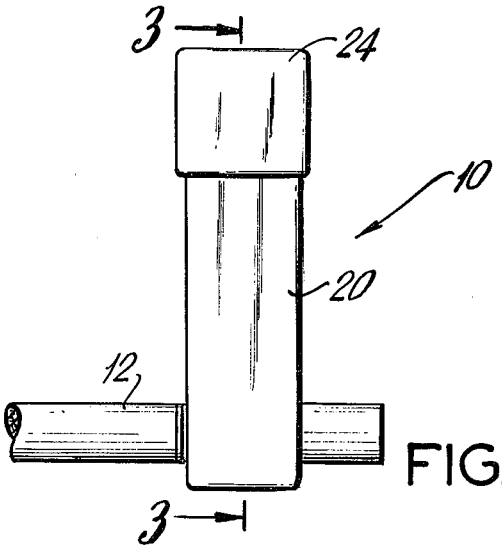
FIG. 2 is a side view of the apparatus of FIG. 1 with a cigarette positioned therein for treatment in accordance with the invention.

As shown in FIGS. 1 and 2, apparatus 10 for treating a filter cigarette 12 includes a body 20 having a cylindrical aperture 22 through the lower portion thereof, and an overfitting cap 24 reciprocally mounted over the upper portion of the body. Cap 24 is shown in its unactuated outermost position. Aperture 22 need not be cylindrical, but is preferably sized to permit cigarette 12 to be easily inserted therethrough and to engage the side wall (wrapper) of the cigarette so as to maintain coincidence of the longitudinal axes of the cigarette and the aperture while the cigarette is in the aperture. The device is preferably small enough that it can be conveniently carried in the pocket or handbag of the smoker.

Figure 3:
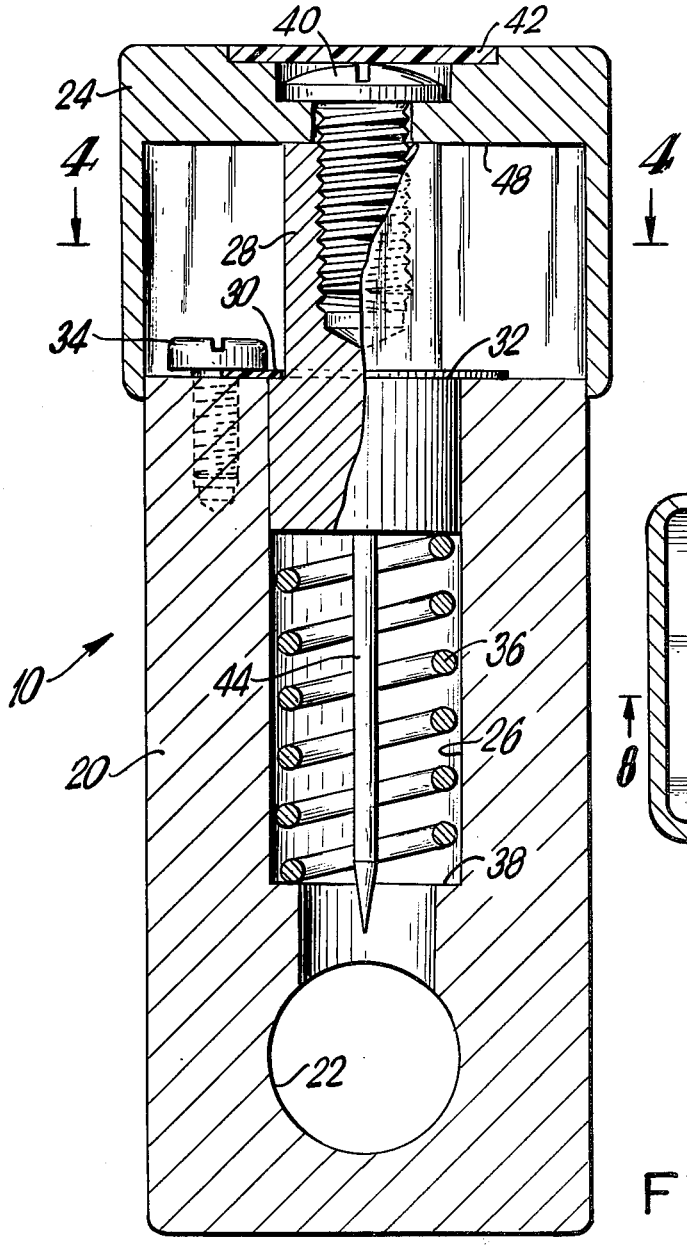
FIG. 3 is a sectional view of the apparatus taken along the line 3—3 in FIG. 2.
Figure 4:
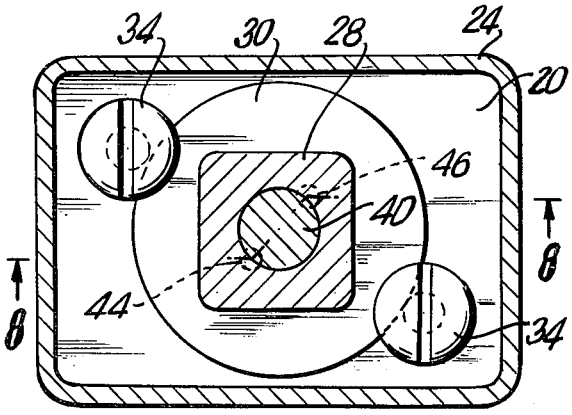
FIG. 4 is a sectional view of the apparatus taken along the line 4—4 in FIG. 3.
Figure 5:
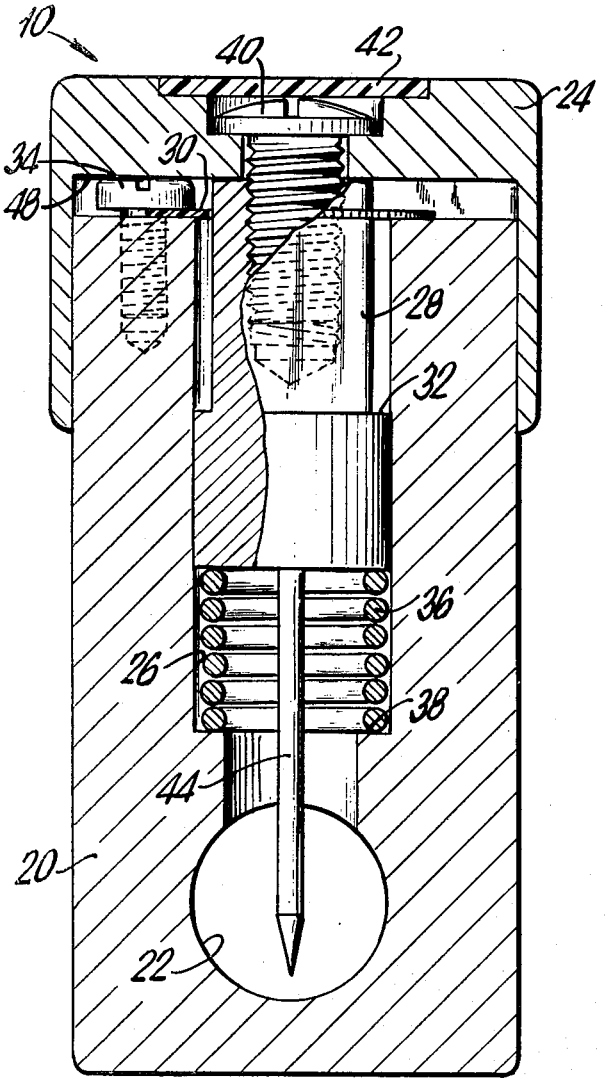
FIG. 5 is a sectional view similar to FIG. 3 showing the apparatus in the fully actuated condition.

As shown in greater detail in FIG. 3, body 20 includes a second aperture 26 under cap 24 which is perpendicular to the axis of, and communicates with, aperture 22. Although in the particular embodiments shown in FIGS. 1-5 and 8, aperture 26 is perpendicular to aperture 22 and the transverse ducts produced by the apparatus are therefore perpendicular to the longitudinal axis of the cigarette, this is not necessarily the case, and these apertures may be formed at various angles to one another to produce transverse ducts having various angles of penetration as shown, for example, in FIG. 10 and discussed in greater detail below. Plunger 28 is disposed in aperture 26 for reciprocal motion along the axis of aperture 26 and therefore perpendicular to the axis of aperture 22. Plunger 28 is retained in aperture 26 by collar 30 in cooperation with transverse plunger surface 32. As best shown in FIG. 4, collar 30 is held in place by screws 34 which are threaded into the top of body 20. Alternatively, other forms of fasteners such as rivets may be used, or collar 30 and screws 34 may be omitted and plunger 28 retained by crimping in the top edge of aperture 26 above surface 32.

Plunger 28 is biased outwardly in aperture 26 by compression coil spring 36 disposed in aperture 26 between the lower surface of plunger 28 and transverse aperture surface 38. Cap 24 is attached to the upper end of plunger 28 by screw 40 threaded into plunger 28 through the center of the cap. Alternatively, other means such as rivets or adhesive may be used to attach cap 24 to the top of plunger 28. If desired, the head of screw 40 may be hidden under plate 42 to give the apparatus a more finished appearance. Plate 42 may be held in place in a recess in cap 24 by adhesive or a close fit between the edge of plate 42 and the sides of the recess.

Incisor 44 extends from the lower end of plunger 28 downward toward aperture 22 perpendicular to the axis of that aperture. In the embodiment shown in FIG. 3, the projected longitudinal axis of incisor 44 intersects the longitudinal axis of aperture 22. However, this is not necessarily the case, and the projected longitudinal axis of incisor 44 may lie on either side of the axis of aperture 22 as long as the transverse ducts produced by the incisor in a cigarette inserted in aperture 22 meet the criteria discussed in detail below.

Incisor 44 as shown in FIG. 3 is a sharply pointed cylindrical rod. Typically, the diameter of this rod is about 0.020 to 0.047 inch, preferably about 0.032 inch. The incisor rod has a conical point, typically having a taper of about 13°. Alternatively, the incisor rod may have a chisel point, a swedge point, or any other pointed shape for ease of penetration of a cigarette as described below. Similarly, incisor 44 need not be circular in cross section, but may have any of several other cross sectional shapes (e.g., square, rectangular, eliptical) of approximately the same area as the circular shapes mentioned above and which do not have a periphery more than about twice the circumference of a circle of the same area.

As mentioned above, plunger 28 is mounted for reciprocal motion in aperture 26. Cap 24 and spring 36 cooperate to comprise means for reciprocally moving plunger 28. Cap 24 is manually compressed down over the upper portion of body 20 to move plunger 28 downward against the upward or outward bias provided by spring 36. Plunger 28 is restored to its original position by spring 36 when the manual pressure on cap 24 is released. The downward travel of plunger 28 is limited by the inside surface 48 of the cap 24 contacting the heads of screws 34. The apparatus is shown with plunger 28 in the extreme downward position in FIG. 5. The return travel of the plunger is limited by plunger surface 32 contacting collar 30 as mentioned above.

When plunger 28 is in its original position prior to compression of cap 24 (FIG. 3), incisor 44 is wholly within aperture 26 and does not extend into aperture 22. As cap 24 is compressed, the lower end of incisor 44 enters aperture 22 and penetrates a cigarette positioned therein as described below. At the limit of travel of plunger 28 (FIG. 5), incisor 44 extends into aperture 22 a distance greater than the radius but less than the diameter of that aperture. The point of incisor 44 does not reach the side of aperture 22 opposite the point of entry. When the compression of cap 24 is released, the plunger 28 returns to its original position and incisor 44 is completely withdrawn from aperture 22 (FIG. 3). Although in the particular embodiments shown in FIGS. 1-5 and 8, the incisors do not extend all the way across aperture 22 and each transverse duct produced by the apparatus therefore passes through only one side of the cigarette, this is not necessarily the case, and the apparatus may be modified to permit the incisors to pass all the way through the cigarette as shown, for example, in FIG. 9 and described in greater detail below.

In accordance with the invention, the above-described apparatus is used to treat a cigarette prior to smoking it as follows. The cigarette is positioned in aperture 22 as shown, for example, in FIG. 2 so that a portion of the cigarette which will remain outside the smoker's mouth, and preferably also will remain unsmoked, is within aperture 22 opposite the end of incisor 44. Assuming the cigarette is a filter cigarette, the portion opposite the end of incisor 44 (i.e., the portion of the cigarette to which the incisor is applied) is preferably the portion of the filter approximately 0.5 to 1.0 inch from the filter end of the cigarette, but it may also be a portion of the cigarette outside this range, including the tobacco-filled part of the cigarette.

When the cigarette is positioned as described above, cap 24 is compressed to cause incisor 44 to penetrate the cigarette to form a transverse perforation or duct in the cigarette perpendicular to the longitudinal axis of the cigarette. Although cap 24 is preferably fully compressed, it can be compressed to a lesser degree if reduced depth of penetration of the cigarette is desired. Cap 24 is then released and incisor 44 is accordingly withdrawn from the cigarette leaving the transverse duct therein. The cigarette is removed from aperture 22 and can be smoked with a beneficial alteration in the composition of the smoke constituents received by the smoker as discussed in greater detail below.

The transverse duct thus formed in the cigarette extends through only one side of the cigarette and has length greater than the radius but less than the diameter of the cigarette. Preferably, the duct extends to within 0.005 inch of the side of the cigarette opposite the point of entry of the incisor. The duct may be either on a diameter of the cigarette, as when the apparatus shown in FIGS. 1–5 is employed, or it may be on any chord of the cigarette of sufficient length to permit a duct of the required length.

If more than one transverse duct is required or desired, the first duct may be formed as described above. Additional ducts may then be formed by changing the longitudinal and/or angular position of the cigarette in aperture 22 and operating cap 24 again. This procedure can be repeated as many times as desired to produce any number and pattern of ducts. Preferably when multiple ducts are desired, the longitudinal and angular (circumferential) position of the cigarette is changed in progressive increments between operations of cap 24. This produces a series of ducts having points of entry in a preferred spiral pattern. The longitudinal spacing between the axes of the ducts in such a spiral pattern is preferably 0.07 to 0.11 inch, and the circumferential spacing is preferably also 0.07 to 0.11 inch and preferably the same as the longitudinal spacing.

Figure 6:
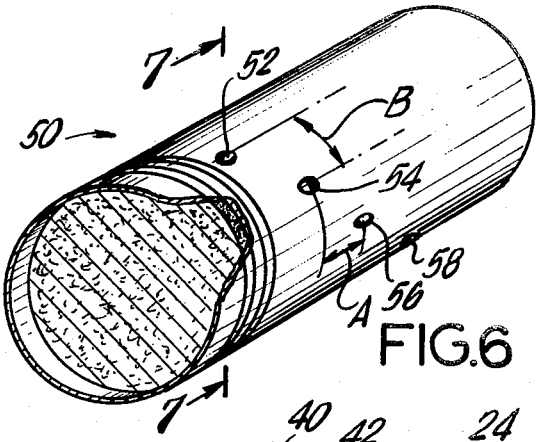
FIG. 6 is a partial perspective view of a filter cigarette treated in accordance with the invention.
Figure 7:
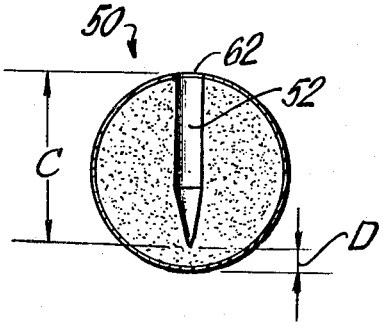
FIG. 7 is a sectional view taken along the line 7—7 in FIG. 6.

FIG. 6 illustrates a cigarette 50 with four transverse ducts 52, 54, 56, 58 in the filter portion 60 thereof in accordance with the invention. As shown in FIG. 6, the points of entry of ducts 52, 54, etc. form the above-mentioned preferred spiral pattern along the side surface of the cigarette. The longitudinal and circumferential spacing of the points of entry are respectively dimensions A and B, both preferably in the range from 0.07 to 0.11 inch as mentioned above. As shown in FIG. 7, typical transverse duct 52 extends through only one side of the cigarette at point 62. The length C of duct 52 is greater than the radius but less than the diameter of the cigarette. The duct extends to within a distance D of the opposite side of the cigarette. Dimension D is preferably approximately 0.005 inch as mentioned above.

Ducts 52, 54, etc. are preferably formed in order by alternately operating the device and repositioning the cigarette in aperture 22 by regular longitudinal and angular increments. The thickness of body 20 may be chosen to facilitate proper longitudinal spacing of the ducts. For example, the thickness of body 20 may be a low even integer multiple of the recommended spacing between ducts so that another duct is formed when the cigarette is moved longitudinally in aperture 22 a sufficient distance to reveal a previously formed duct. Similarly, indicia may be provided on the surface of body 20 near one or both entrances to aperture 22 to indicate the proper angular position of a previously formed duct when the cigarette is positioned to receive another duct with the recommended circumferential spacing.

Figure 8:
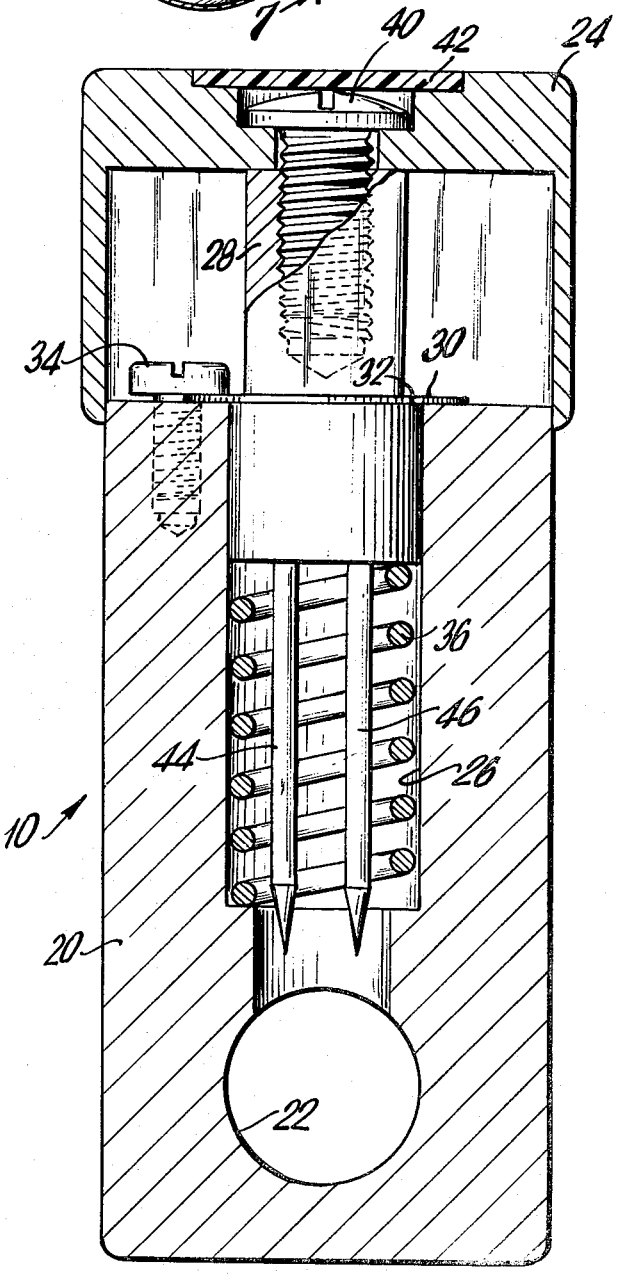
FIG. 8 is a sectional view similar to FIG. 3, but taken as indicated by the line 8—8 in FIG. 4, showing a modification of the apparatus in accordance with the invention.

Although in the embodiment shown in FIGS. 1–5 there is only one incisor on the plunger, two or more parallel incisors may be included on the plunger, if desired. For example, FIG. 8 shows how the apparatus of FIGS. 1–5 can be modified to include two parallel incisors 44 and 46. In other respects, the apparatus of FIG. 8 is similar to the apparatus of FIGS. 1–5. Incisors 44 and 46 are preferably at different longitudinal and circumferential positions relative to a cigarette positioned in aperture 22 as indicated by the locations of dotted circles 44 and 46 in FIG. 4. For example, the projections of the longitudinal axes of incisors 44 and 46 preferably pass on opposite sides of the axis of aperture 22. Similarly, one of the incisors is preferably closer to the end of a cigarette positioned in aperture 22 than the other incisor. Preferably, a line drawn between the ends of incisors 44, 46 in FIG. 8 forms an angle of 30° to 60°, most preferably 45°, with the axis of aperture 22. The spacing between the axes of incisors 44 and 46 is typically 0.1 to 0.15 inch. Accordingly, by a single operation of cap 24 two transverse ducts are formed in the cigarette in a spiral pattern similar to that shown in FIG. 6. An extended spiral pattern of four, six, or more ducts can be formed in the manner of FIG. 6 by operating cap 24 and then longitudinally and angularly (circumferentially) repositioning the cigarette appropriately before actuating cap 24 again. Although the apparatus of FIG. 8 produces ducts in parallel pairs along chords, rather than diameters, of the cigarette, the result is similar to that achieved by a similar number and arrangement of ducts produced by the apparatus of FIGS. 1–5.

Cigarettes treated in accordance with the invention have been found to permit substantial step-wise reduction in the quantities of tar, nicotine and undesirable gases received by a smoker without undue interference with the smoking act. In addition, the treatment of this invention permits reduction of the nicotine received by the smoker in steps which are acceptable to him and which therefore permit substantial reduction or breaking of the smoking habit without trauma.

The foregoing is illustrated by the data in Tables I, II, and III below. The data in Tables I and II were derived by automatic smoking of popular commercially available 98 mm cigarettes to butts 3 mm longer than the end of the filter overwrap. According to usual standards, the smoking protocol was one 2 second, 35 ml puff per minute. The ducts were formed using cylindrical incisors having 0.040 inch diameter. The data in Table III was derived similarly. All data is from analysis of mainstream smoke. In Table II, "FTC-TPM" means total particulate matter ("tar") as defined by the Federal Trade Commission, i.e., the wet total particulate matter minus moisture and nicotine.

TABLE I

| Number of Ducts | Draw Resistance (mm $H_2O$) | Number of Puffs | Nicotine (mg) | % Reduction |
|---|---|---|---|---|
| 0 (Control) | 135 | 8.0 | 1.13 | — |
| 1 | 105 | 8.6 | 0.97 | 14 |
| 2 | 95 | 9.3 | 0.86 | 24 |
| 4 | 69 | 10.0 | 0.50 | 56 |
| 6 | 56 | 10.6 | 0.30 | 73 |

TABLE II

| Number of Ducts | FTC-TPM (mg) | % Reduction | CO (mg) | % Reduction |
|---|---|---|---|---|
| 0 (Control) | 15.7 | — | 15.8 | — |
| 1 | 12.4 | 21 | 9.1 | 42 |
| 2 | 10.7 | 32 | 8.3 | 47 |
| 4 | 5.5 | 65 | 3.1 | 80 |
| 6 | 1.8 | 89 | 1.3 | 92 |

TABLE III

| Number of Ducts | Hydrogen Cyanide (Gas Phase) (μg) | Hydrogen Cyanide (Particulate) (μg) | Total Hydrogen Cyanide (μg) | % Reduction |
|---|---|---|---|---|
| 0 (Control) | 176 | 126 | 302 | — |
| 1 | 144 | 53 | 197 | 35 |
| 2 | 113 | 48 | 161 | 47 |
| 4 | 44 | 20 | 64 | 79 |
| 6 | 20 | 5 | 25 | 92 |

As is apparent from Tables I–III, substantial reductions can be achieved in particulate matter including nicotine and undesirable gases such as carbon monoxide (CO) and hydrogen cyanide in accordance with the invention. The amount of alteration in any of the smoke constituents depends on many factors including the cigarette brand (which determines the kind and packing density of the tobacco, the porosity of the wrapper, the type of filter, if any, etc.), the size and shape of the incisor, the number and placement of the ducts, etc. Furthermore, for different cigarettes the various smoke constituents may be altered differently. For example, the data in Tables IV and V were derived by automatic smoking of another brand of popular commercially available 93 mm cigarettes using a smoking protocol similar to that described above. In this case cylindrical incisors 0.035 inch in diameter were used.

TABLE IV

| Number of Ducts | Draw Resistance (mm $H_2O$) | Number of Puffs | Nicotine (mg) | % Reduction |
|---|---|---|---|---|
| 0 (Control) | 142 | 11.3 | 1.36 | — |
| 2 | 103 | 12.4 | 1.14 | 16 |
| 4 | 83 | 13.0 | 0.68 | 50 |
| 6 | 76 | 12.9 | 0.35 | 74 |
| 8 | 60 | 13.2 | 0.11 | 92 |

TABLE V

| Number of Ducts | FTC-TPM (mg) | % Reduction | CO (mg) | % Reduction |
|---|---|---|---|---|
| 0 (Control) | 17.7 | — | 20.0 | — |
| 2 | 12.1 | 32 | 9.51 | 52 |
| 4 | 6.1 | 65 | 4.05 | 80 |
| 6 | 2.5 | 66 | 0.59 | 97 |
| 8 | 0.63 | 96 | 0.36 | 98 |

As shown by Tables I and IV, nicotine reductions in controlled steps can be achieved by gradually increasing the number of transverse ducts. As mentioned above, it has been found that smokers can tolerate nicotine reductions of up to about 25% without substantial adverse effects. The treatment of cigarettes in accordance with the invention therefore makes it possible to reduce nicotine consumption in readily tolerable steps by gradually increasing the number of ducts in successive cigarettes. In addition, the treatment does not have a too drastic effect on other characteristics of the cigarette such as its draw resistance or the number of puffs required to consume it. Accordingly, the treatment does not unduly interfere with smoking.

In view of the foregoing, the smoking habit may be substantially reduced or broken in accordance with the invention by treating successive cigarettes with increasing numbers of transverse ducts as described above, thereby allowing a progressive reduction in the smoke constituents which maintain the smoking habit. Preferably, each increase in the number of ducts produces a reduction of less than about 25% in the amount of nicotine received by the smoker, and each reduction is made only after the smoker has fully adjusted to the previous reduction. A particularly preferred method of reducing or breaking the smoking habit includes forming two, four, six, and eight ducts in respective first, second, third, and fourth groups of cigarettes. The number of ducts is increased only after the smoker has become accustomed to the last decrease in nicotine consumption. Although any apparatus capable of forming transverse ducts as discussed above in a cigarette can be used, the ducts are preferably formed by apparatus of the type shown in FIGS. 1–5 and 8. In particular, the preferred sequence of two, four, six, and eight ducts are preferably formed in pairs by apparatus of the type shown in FIG. 8. The multiple ducts are preferably formed in a spiral pattern as shown in FIG. 6. All of the ducts preferably have the dimensions and spacing discussed above in relation to FIGS. 1–8.

Treating each cigarette before it is smoked as discussed above also helps in reducing or breaking the smoking habit by introducing a conscious and deliberately performed action into the habitual sequence of smoking activity which tends to break the unconscious automaticity of the habit and thereby helps to discourage it.

Figure 9:
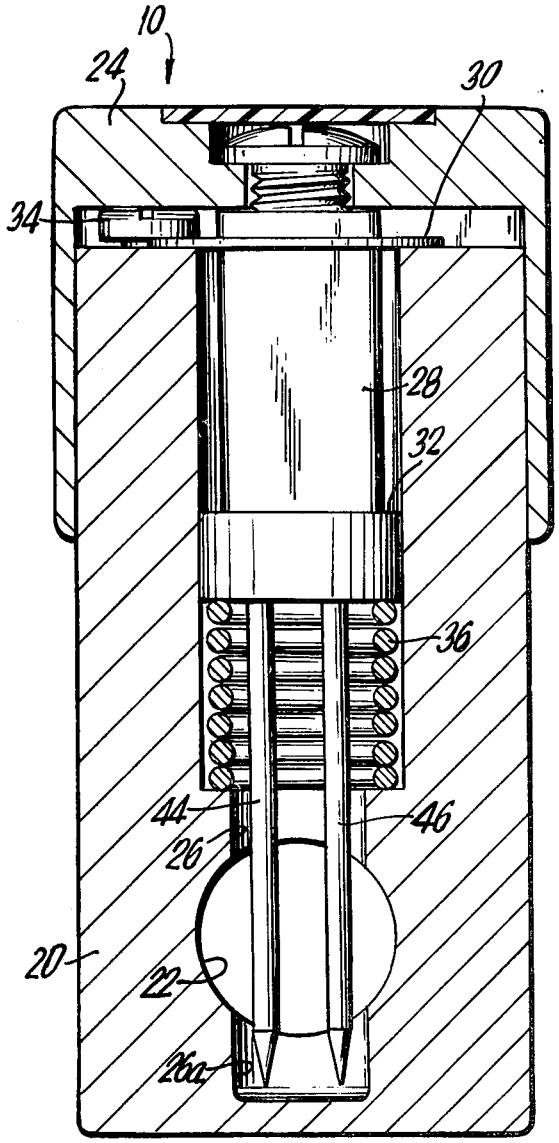
FIG. 9 is a sectional view similar to FIG. 8 showing another modification of the apparatus in accordance with the invention.

FIG. 9 shows how the apparatus of the invention can be modified to form transverse ducts extending all the way through a cigarette. The apparatus of FIG. 9 has two incisors like the apparatus of FIG. 8 and is shown with cap 24 fully compressed as in FIG. 5. In the apparatus of FIG. 9, however, aperture 26 continues on the opposite side of aperture 22 to form a well **26*a* for receiving the ends of incisors 44 and 46 when cap 24 is fully compressed as shown in this Figure. As compared to the apparatus of FIG. 8, incisors 44 and 46 are somewhat longer in FIG. 9 and plunger 28 is correspondingly longer above transverse plunger surface 32. Accordingly, the stroke of plunger 28 is longer in the apparatus of FIG. 9 and the ends of incisors 44 and 46 travel all the way across aperture 22 and into well 26***a* when cap 24 is operated. Incisors 44 and 46 therefore form ducts which extend all the way across a cigarette positioned in aperture 22. In other respects the apparatus of FIG. 9 may be similar to the apparatus of FIGS. 1–5 and 8.

Figure 10:
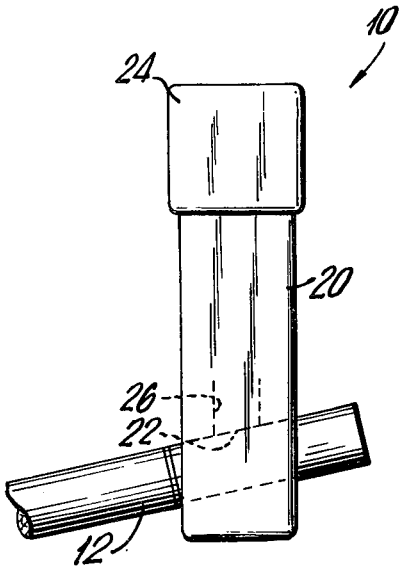
FIG. 10 is a side view similar to FIG. 2 showing still another modification of the apparatus in accordance with the invention.

FIG. 10 shows how the apparatus of the invention can be modified to form transverse ducts which are not perpendicular to the longitudinal axis of a cigarette. Instead of being formed with its longitudinal axis perpendicular to the longitudinal axis of aperture 26, aperture 22 is formed at any desired angle to aperture 26. Aperture 22 then holds cigarette 12 at that angle to aperture 26 and the incisor or incisors therein, and ducts are formed at that angle to the longitudinal axis of the cigarette. In other respects, the apparatus of FIG. 10 may be similar to any of the previously discussed apparatus.

Although the invention has been described primarily in its application to filter cigarettes, it will be understood that the invention is equally applicable to treating other similar smoking articles such as unfiltered cigarettes and cigars. For example, the apparatus shown in FIGS. 1–5 and 8–10 can be used without modification to treat unfiltered cigarettes. Apparatus with a larger aperture 22 and possibly with a longer plunger stroke can be provided for treating cigars which are larger in diameter than conventional cigarettes. Similarly, apparatus with a smaller aperture 22 can be provided for treating so-called thin cigarettes. Alternatively, a C-shaped insert can be provided for insertion in aperture 22 in the apparatus of FIGS. 1–5 and 8 and 10 to effectively reduce the diameter of aperture 22 and thereby enable the smoker to optionally modify the apparatus for treatment of thin cigarettes. The C-shaped insert is positioned in aperture 22 with the opening up to admit the incisor or incisors into the insert. If this arrangement is used, the incisor or incisors preferably do not extend so far into aperture 22 that they reach the opposite side of the C-shaped insert.

It will be understood that the foregoing is illustrative of the principles of the invention only and that various modifications may be made by those skilled in the art without departing from the spirit or scope of the invention. For example, the size and shape of the incisor or incisors can be modified as discussed in detail above.

What is claimed is:

1. Apparatus for treating a smoking article to reduce the quantities of undesirable smoke constituents received by the smoker comprising:

a body having a first aperture for receiving a smoking article with its longitudinal axis aligned with the axis of the first aperture, and a second aperture at an angle to the axis of the first aperture and communicating therewith;

a plunger disposed in the second aperture for reciprocal motion along the axis of the second aperture, said plunger having first and second incisors extending from the end of the plunger parallel to the axis of the second aperture and adjacent to the first aperture, said first and second incisors having a diameter within the range of 0.020–0.047 inches;

said incisors being disposed such that a projection of the longitudinal axis of each of said incisors pass on opposite sides of the axis of the first aperture in a manner such that a line between the ends of the incisors forms an angle between 30° to 60° with the axis of the first aperture; and means for reciprocating the plunger within the second aperture so that the incisors enter the first aperture to form transverse ducts in a smoking article disposed therein, the duct extending through at least one side of the smoking article and having a length greater than the radius of the smoking article.

2. The apparatus defined in claim 1 wherein a line between the ends of the incisors forms an angle of 45° with the axis of the first aperture.

3. A method of breaking the smoking habit by treating successive groups of smoking articles to provide a step-wise reduction in the quantity of nicotine received by the smoker from the smoking articles in each successive group comprising forming an increasing number of transverse ducts in successive groups of smoking articles, said transverse duct being formed by extending an incisor having a diameter within the range of 0.020–0.047 of an inch into the successive groups of smoking articles, each transverse duct extending through the portion of the side wall of the smoking article which remains outside the smoker's mouth and having length greater than the radius of the smoking article, and smoking the smoking articles in each group for a sufficient period of time to overcome the desire for the quantity of nicotine received from the smoking articles in the preceding group before beginning to smoke the smoking articles in the succeeding group.

4. The method defined in claim 3 wherein each increase in the number of ducts produces a decrease of less than about 25% in the quantity of nicotine received by the smoker from the smoking article.

5. The method defined in claim 3 wherein the ducts are formed with points of entry spaced longitudinally and circumferentially to form a spiral pattern on the side wall of the smoking article.

6. The method defined in claim 5 wherein two, four, six, and eight transverse ducts are respectively formed in successive first, second, third, and fourth groups of smoking articles.

7. The method defined in claim 5 wherein the transverse ducts are formed in adjacent pairs of parallel ducts, the ducts in each pair being spaced on opposite sides of the longitudinal axis of the smoking article.

8. The method defined in claim 7 wherein the points of entry of the ducts are spaced 0.07 to 0.11 inch longitudinally and circumferentially.

9. The method defined in claim 8 wherein the transverse ducts are cylindrical and have a diameter of 0.020 to 0.047 inch.

* * * * *